US012696936B2

(12) United States Patent
Yoshida et al.

(10) Patent No.: US 12,696,936 B2
(45) Date of Patent: Aug. 4, 2026

(54) INHALER DEVICE, DISPLAY DEVICE, DISPLAY METHOD, AND PROGRAM

(71) Applicant: Japan Tobacco Inc., Tokyo (JP)

(72) Inventors: Ryo Yoshida, Tokyo (JP); Tatsunari Aoyama, Tokyo (JP); Hiroshi Kawanago, Tokyo (JP); Toru Nagahama, Tokyo (JP); Takashi Fujiki, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 648 days.

(21) Appl. No.: 18/062,341

(22) Filed: Dec. 6, 2022

(65) Prior Publication Data

US 2023/0105963 A1 Apr. 6, 2023

Related U.S. Application Data

(63) Continuation of application No. PCT/JP2021/046771, filed on Dec. 17, 2021.

(30) Foreign Application Priority Data

Apr. 28, 2021 (JP) ..... 2021-075851

(51) Int. Cl.
*A24F 40/60* (2020.01)
*A24F 40/10* (2020.01)
(Continued)

(52) U.S. Cl.
CPC ..... *A24F 40/60* (2020.01); *A24F 40/10* (2020.01); *A24F 40/40* (2020.01); *A24F 40/53* (2020.01)

(58) Field of Classification Search
CPC ..... A24F 40/60; A24F 40/53; A24F 40/10; A24F 40/40
See application file for complete search history.

(56) References Cited

U.S. PATENT DOCUMENTS

2019/0293613 A1 9/2019 Yamane
2020/0352230 A1* 11/2020 An ..... A24F 40/40
(Continued)

FOREIGN PATENT DOCUMENTS

CN 110308234 A 10/2019
EP 3 711 502 A1 9/2020
(Continued)

OTHER PUBLICATIONS

International Search Report, issued in PCT/JP2021/046771, PCT/ISA/210, dated Feb. 15, 2022.
(Continued)

*Primary Examiner* — Michael H. Wilson
*Assistant Examiner* — Stephanie Lynn Moore
(74) *Attorney, Agent, or Firm* — Birch, Stewart, Kolasch & Birch, LLP

(57) ABSTRACT

A display device includes a plurality of displays, and a controller. The displays are configured to, when an apparatus is performing an operation, display a state of the apparatus. The controller is configured to, in response to an error occurring in the apparatus, display an indication of occurrence of the error on the displays in a manner that causes a first subset and a second subset of the displays to turn on, and that causes a third subset of the displays to turn off.

12 Claims, 9 Drawing Sheets

(51) Int. Cl.
*A24F 40/40* (2020.01)
*A24F 40/53* (2020.01)

(56) References Cited

U.S. PATENT DOCUMENTS

| | | | | |
|---|---|---|---|---|
| 2021/0059314 | A1 | 3/2021 | Talbot et al. | |
| 2021/0212378 | A1* | 7/2021 | Pellegrini | A24F 40/65 |
| 2021/0235768 | A1 | 8/2021 | Akao et al. | |

FOREIGN PATENT DOCUMENTS

| | | | | |
|---|---|---|---|---|
| EP | 3793384 | B1 * | 12/2024 | G08B 5/38 |
| JP | 9-152235 | A | 6/1997 | |
| JP | 2020-68690 | A | 5/2020 | |
| JP | 2020-68762 | A | 5/2020 | |
| WO | WO 2019/220348 | A1 | 11/2019 | |
| WO | WO 2020/065986 | A1 | 4/2020 | |

OTHER PUBLICATIONS

Extended European Search Report for European Application No. 21939390.7, dated Mar. 14, 2025.
Japanese Office Action for Japanese Application No. 2022-568845, dated Aug. 19, 2025, with English translation.

* cited by examiner

INHALER DEVICE, DISPLAY DEVICE, DISPLAY METHOD, AND PROGRAM

CROSS REFERENCE TO RELATED APPLICATIONS

This application is a Continuation of PCT International Application No. PCT/JP2021/046771 filed on Dec. 17, 2021, which claims priority under 35 U.S.C. § 119(a) to Patent Application No. 2021-075851 filed in Japan on Apr. 28, 2021, all of which are hereby expressly incorporated by reference into the present application.

TECHNICAL FIELD

The present disclosure relates to an inhaler device, a display device, a display method, and a program.

CITATION LIST

Patent Literature

PTL 1: Japanese Unexamined Patent Application Publication No. 2020-68762

PTL 2: Japanese Unexamined Patent Application Publication No. 2020-68690

SOLUTION TO PROBLEM

To this end, the present disclosure provides an inhaler device including a heater, a plurality of displays, and a controller. The heater heats a substrate with electric power to generate an aerosol. The substrate retains an aerosol source. The electric power is provided from a battery. The displays are configured to, when the inhaler device is performing an operation, display a state of the inhaler device. The controller is configured to, in response to an error occurring in the inhaler device, display an indication of occurrence of the error on the displays in a manner that causes a first subset and a second subset of the displays to turn on, and that causes a third subset of the displays to turn off.

The first subset may include one display at an end of the displays, and the second subset may include one display at an other end of the displays.

The displays may be arranged continuously.

The operation may be at least one of an operation of heating the substrate, an operation of enabling inhalation of the aerosol, an operation of providing notification of a remaining level of the battery, or an operation of charging the battery.

The error may be an error that is recoverable neither by an action performed on the inhaler device nor by passage of time. In that case, the controller may be configured to, in response to electric power being supplied from an external source with the error occurring, display the indication of occurrence of the error on the displays. The controller may be configured to, after the indication of occurrence of the error is displayed for a predetermined time, end display of the indication of occurrence of the error. The controller may be configured to, in response to a shutter being opened after display of the indication of occurrence of the error ends, display the indication of occurrence of the error on the displays again. The shutter is a shutter for an opening into which the substrate is to be inserted. The controller may be configured to, in response to a button being depressed after display of the indication of occurrence of the error ends, display the indication of occurrence of the error on the displays again. The button is a button for supplying electric power from the battery to the heater. The controller may be configured to, in response to a protection component for the inhaler device being removed after display of the indication of occurrence of the error ends, display the indication of occurrence of the error on the displays again.

The present disclosure also provides a display device. The display device includes a plurality of displays, and a controller. The displays are configured to, when an apparatus is performing an operation, display a state of the apparatus. The controller is configured to, in response to an error occurring in the apparatus, display an indication of occurrence of the error on the displays in a manner that causes a first subset and a second subset of the displays to turn on, and that causes a third subset of the displays to turn off.

The first subset may include one display at an end of the displays, and the second subset may include one display at an other end of the displays.

The displays may be arranged continuously.

Further, the present disclosure provides a display method including the steps of: when an apparatus is performing an operation, displaying a state of the apparatus on a plurality of displays; and in response to an error occurring in the apparatus, displaying an indication of occurrence of the error on the displays in a manner that causes a first subset and a second subset of the displays to turn on, and that causes a third subset of the displays to turn off.

Still further, the present disclosure provides a program for causing a computer to implement the functions of: when an apparatus is performing an operation, displaying a state of the apparatus on a plurality of displays; and in response to an error occurring in the apparatus, displaying an indication of occurrence of the error on the displays in a manner that causes a first subset and a second subset of the displays to turn on, and that causes a third subset of the displays to turn off.

DESCRIPTION OF EMBODIMENTS

An embodiment of the present disclosure will be described below in detail with reference to the attached drawings.

Exemplary Configuration of Inhaler Device

Figure 1:
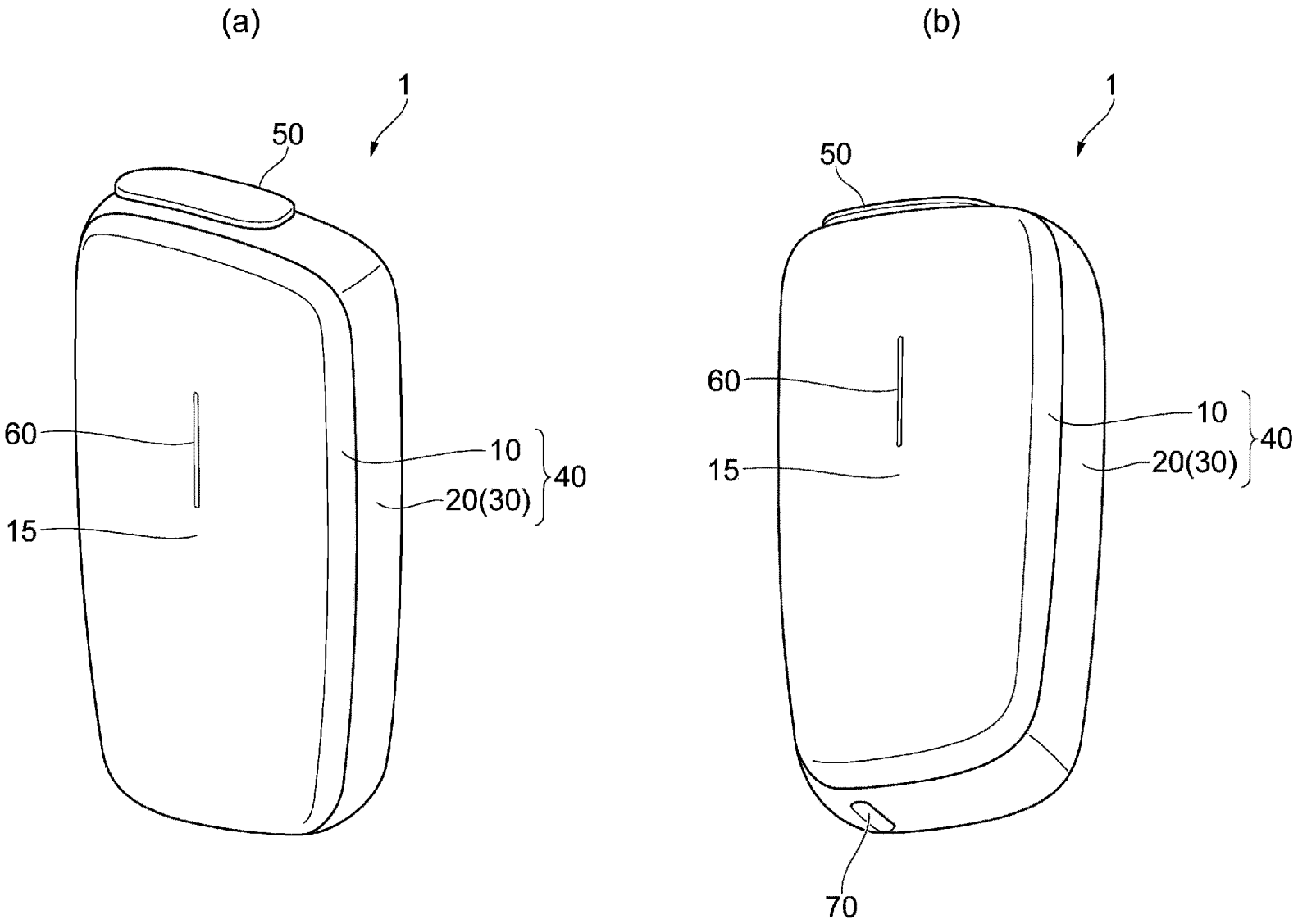
FIGS. 1(*a*) and (*b*) illustrate, in general perspective view, an inhaler device according to an embodiment of the present disclosure.

FIGS. 1(*a*) and 1(*b*) illustrate, in general perspective view, an inhaler device 1 according to the embodiment of the present disclosure. FIG. 1(*a*) is a general perspective view as seen obliquely from above, and FIG. 1(*b*) illustrates a general perspective view as seen obliquely from below. As illustrated in FIGS. 1(*a*) and 1(*b*), the inhaler device 1 includes a panel 10, a body housing 20 to which the panel 10 can be removably attached, and a shutter 50. The panel 10 and the body housing 20 are formed as separate components. The panel 10 includes a display window 60 provided on its surface and made of a transparent material. The body housing 20 accommodates a body 30 of the inhaler device 1. The body housing 20 includes an external connection terminal 70, such as a USB Type-C connector.

A combination of the panel 10 attached to the body housing 20 defines a housing 40, which serves as the outermost housing of the inhaler device 1. The panel 10 provided to the inhaler device 1 helps to ensure that even if the body 30 generates heat, the panel 10 serves as a buffer against release of heat to the external environment. That is, the panel 10 serves to insulate heat generated from a heater included in the body 30. Further, the panel 10 is formed to have a substantially curved surface. When attached to the body housing 20, the panel 10 defines an internal space together with the surface of the body housing 20.

The housing 40 may preferably be dimensioned to fit in a user's hand. The user holds the inhaler device 1 in one hand while keeping fingertips in contact with the surface of the panel 10. As the user presses down on the surface of the panel 10 with fingertips, the panel 10 is deformed to define a recess toward the body housing 20. Such deformation of the panel 10 causes a protrusion on the panel 10 to come into contact with an operational button disposed on the surface of the body housing 20. The operational button is thus depressed. That is, a portion of the surface of the panel 10 to be pressed down on with fingertips defines a button region 15.

To deform the panel 10, for example, the user has to press down on the button region 15 by using a plurality of fingers simultaneously. This requires the user to apply a greater pressing force than when, for example, depressing a single button that protrudes from the surface of the housing with a single finger. This means that the inhaler device 1 according to the embodiment is advantageously capable of preventing erroneous operations not intended by the user, such as an operational button being accidentally depressed inside a bag. The above-mentioned requirement is also advantageous from a child resistance viewpoint, because it is not readily possible for children, who are not appropriate users of the inhaler device 1, to apply a pressing force sufficient to press down on the button region 15 of the panel 10.

The body housing 20 includes an opening into which a stick substrate is to be inserted. The opening is depicted in FIG. 1 as being closed by the shutter 50. The shutter 50 has a slide mechanism, and is capable of moving along the surface of the outer shell between a first position, in which the shutter 50 closes the opening, and a second position, in which the shutter 50 exposes the opening. Whether the opening is exposed or closed can be detected by a sensor (not illustrated) disposed near the first position and/or the second position. For example, the shutter 50 is provided with a magnet, and a magnetic sensor detects whether the opening is exposed or closed.

As the user slides the shutter 50 along the side with a finger or fingers placed on the shutter 50, the opening is exposed. As a result of the opening being exposed, the user is able to insert the stick substrate into the opening. After inserting the stick substrate, the user presses down on the surface of the panel 10 with fingers to thereby depress the operational button. This allows the inhaler device 1 to be powered on.

Exemplary Exterior Configurations of Panel and of Body Housing

Figure 2:
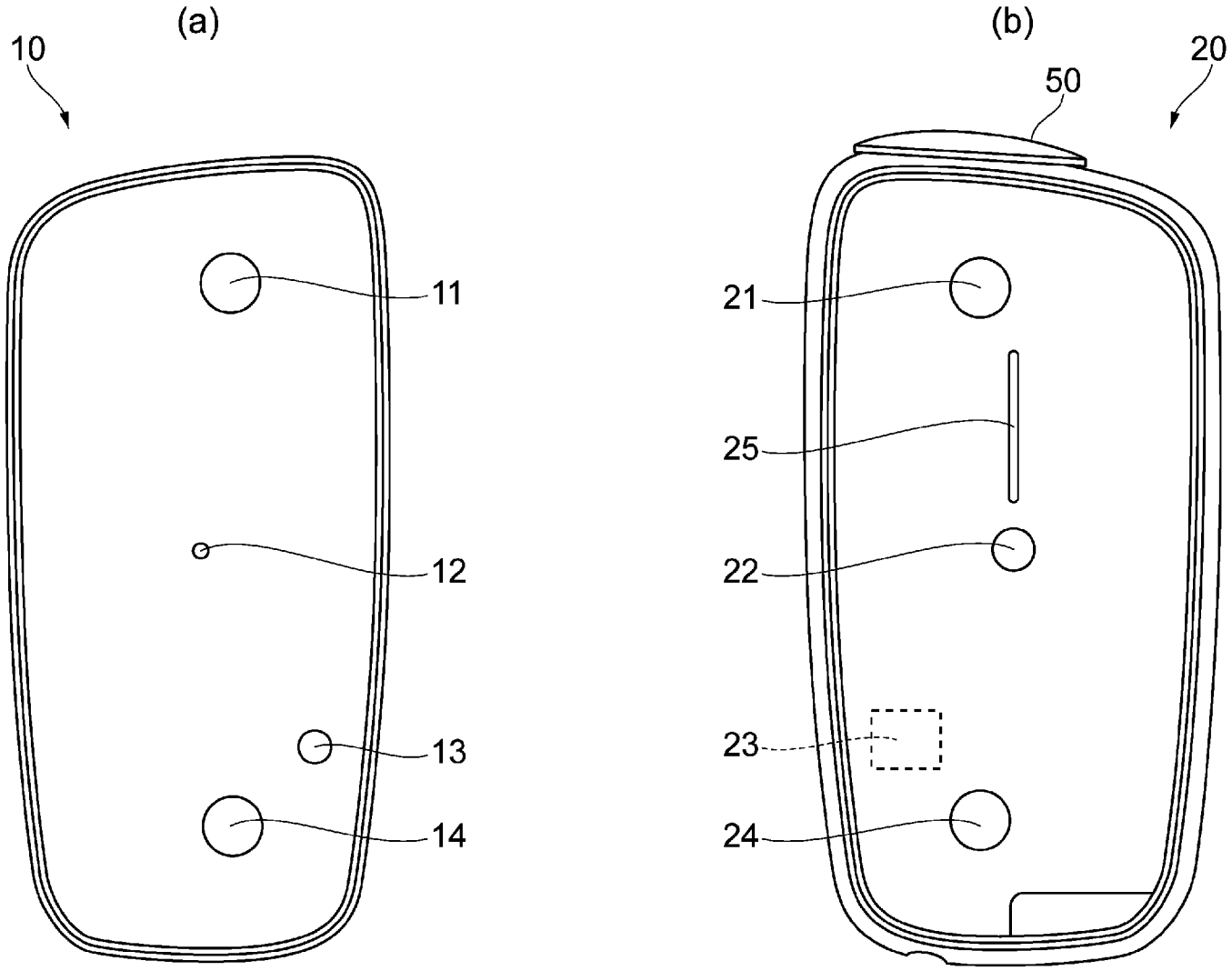
FIGS. 2(*a*) and 2(*b*) illustrate the respective outward appearances of a panel and a body housing of the inhaler device according to the embodiment of the present disclosure.

FIGS. 2(*a*) and 2(*b*) illustrate the respective outward appearances of the panel 10 and the body housing 20 of the inhaler device 1. FIG. 2(*a*) illustrates the outward appearance of the inner surface of the panel 10. FIG. 2(*b*) illustrates the outward appearance of the outer surface of the body housing 20. With the panel 10 attached to the body housing 20, the inner surface of the panel 10, and the outer surface of the body housing 20 face each other.

As illustrated in FIG. 2(*a*), a magnet 11, a protrusion 12, a magnet 13, and a magnet 14 are disposed on the inner surface of the panel 10 in the longitudinal direction. Upon attaching the panel 10 to the body housing 20, the magnetic force (magnetic attraction) exerted by each of the magnets 11 and 14 causes the panel 10 to be sucked onto the body housing 20. The panel 10 is thus retained on the body housing 20. The protrusion 12 serves to depress an operational button 22 disposed on the surface of the body housing 20. The magnet 13 serves as a magnetic-field applicator that applies a magnetic field for detection by a sensor included in the body 30. That is, as the magnetic force of a magnetic field applied from the magnet 13 is detected by a magnetic sensor 23 of the body housing 20, the panel 10 is detected by the magnetic sensor 23.

As illustrated in FIG. 2(*b*), a magnet 21, a passage hole 25, the operational button 22, and a magnet 24 are disposed, in the stated order as seen from the shutter 50, on the outer surface of the body housing 20 in the longitudinal direction. The magnetic sensor 23 is disposed on the inner surface of the body housing 20 (more precisely, in a location on the substrate at a substantially zero distance from the inner surface) such that the magnetic sensor 23 is located between the operational button 22 and the magnet 24 in the longitudinal direction. The magnet 21, the operational button 22, the magnetic sensor 23, and the magnet 24 on the body housing 20 respectively correspond to the magnet 11, the protrusion 12, the magnet 13, and the magnet 14 on the panel 10. That is, upon attaching the panel 10 to the body housing 20, the above-mentioned components on the panel 10 and the corresponding components on the body housing 20 are positioned relative to each other so as to face each other.

The magnets 21 and 24 of the body housing 20 respectively exert magnetic forces (magnetic attractions) that cause the magnets 11 and 14 of the panel 10 to suck onto the magnets 21 and 24. That is, the attraction between the magnets 11 and 21, and the attraction between the magnets 14 and 24 allow the panel 10 to be retained in a manner that allows the panel 10 to be attached to the body housing 20. The magnets 11 and 14 of the panel 10, and the magnets 21 and 24 of the body housing 20 may preferably be permanent magnets.

The operational button 22 is disposed on the surface to which the panel 10 is to be attached. This means that upon attaching the panel 10 to the body housing 20, the operational button 22 is covered by the panel 10, and depressed by the protrusion 12 of the panel 10. This allows the inhaler device 1 to be switched between power-on and power-off states.

The magnetic sensor 23 detects a magnetic force based on a magnetic field applied from the magnet 13 of the panel 10. For example, the magnetic sensor 23 may preferably be a Hall sensor including a Hall element. This makes it possible to detect attachment of the panel 10 to the body housing 20.

The magnetic sensor 23 of the body housing 20 is positioned such that, with the panel 10 attached on the body housing 20, the magnetic sensor 23 faces the magnet 13 of the panel 10 with the inner surface of the body housing 20 therebetween. That is, the magnetic sensor 23 of the body housing 20, and the magnet 13 of the panel 10 have minimum distance from each other when the panel 10 is attached to the body housing 20.

The magnetic sensor 23 of the body housing 20 is configured to not detect magnetic fields produced by the two magnets 21 and 24 of the body housing 20. More specifically, the magnetic sensor 23 may preferably be positioned on the inner surface of the body housing 20 such that the magnetic sensor 23 is spaced away from the two magnets 21 and 24 disposed on the outer surface of the body housing 20. This makes it possible to substantially eliminate the influence that the magnetic fields from the two magnets 21 and 24 exert on the magnetic sensor 23.

Further, the magnetic sensor 23 and the magnet 24 (or the magnet 21) of the body housing 20 may preferably be separated from each other by a distance that is greater than the distance by which the magnet 13 and the magnetic sensor 23 are separated from each other with the panel 10 attached to the body housing 20. As a result, in detecting attachment of the panel 10 to the body housing 20, it is possible to appropriately take into account only the influence that the magnetic field from the magnet 13 exerts on the magnetic sensor 23, without taking into account the influence that the magnetic field from the magnet 24 exerts on the magnetic sensor 23.

The passage hole 25 is an opening positioned to align with one or more light-emitting diodes (LEDs) disposed inside the body 30. The passage hole 25 allows light from the LEDs to pass therethrough to reach the display window 60 of the panel 10. This allows the user to see the light through the outer surface of the panel 10.

Exemplary Configuration of Inhaler Device

Figure 3:
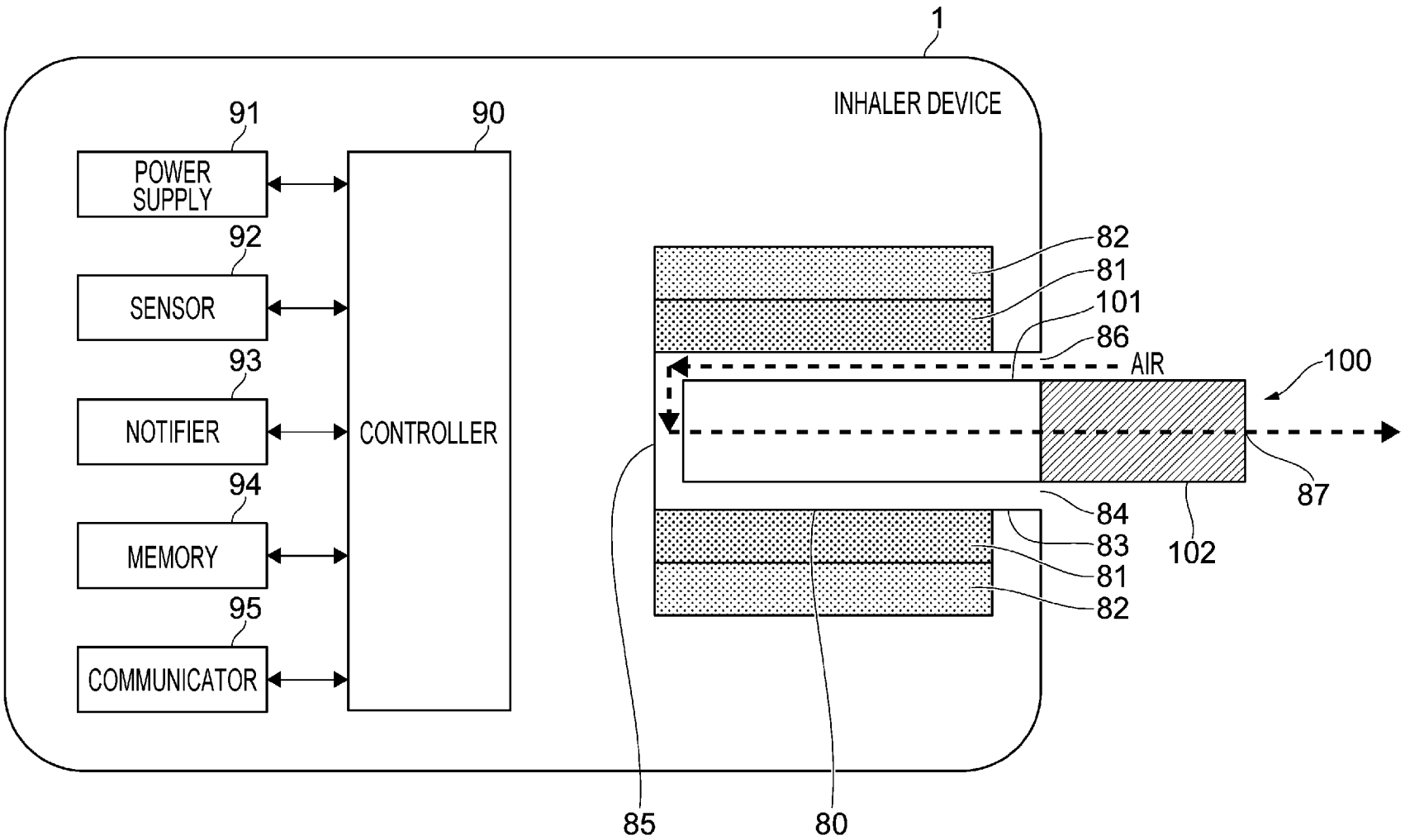
FIG. 3 schematically illustrates an exemplary configuration of the inhaler device according to the embodiment of the present disclosure.

FIG. 3 schematically illustrates an exemplary configuration of the inhaler device 1. The inhaler device 1 is designed to receive, for example, a stick substrate 100 inserted into the inhaler device 1. The stick substrate 100 includes an aerosol source, which is the source of a component to be inhaled, and a flavor-source material such as a filler including a flavor source. The aerosol source is not necessarily a liquid but may be a solid. When inserted, the stick substrate 100 is heated from its outer circumference to thereby generate an aerosol including a flavor.

As illustrated in FIG. 3, the inhaler device 1 includes a controller 90, a power supply 91, a sensor 92, a notifier 93, a memory 94, a communicator 95, a holder 80, a heater 81, and a heat insulator 82. These components of the inhaler device 1 are accommodated in the body 30 illustrated in FIG. 1.

The controller 90 serves as an arithmetic processing unit and a control unit. The controller 90 controls the overall internal operation of the inhaler device 1 in accordance with various programs. The controller 90 is implemented by, for example, an electronic circuit such as a central processing unit (CPU) or a microprocessor.

The power supply 91 stores electric power. The power supply 91 supplies electric power to each component of the inhaler device 1 based on control by the controller 90. The power supply 91 may be in the form of, for example, a rechargeable battery such as a lithium-ion secondary battery.

The sensor 92 acquires various information related to the inhaler device 1. In one example, the sensor 92 is in the form of a pressure sensor such as a condenser microphone, a flow sensor, a temperature sensor, or other such sensor. The sensor 92 acquires a value associated with user's inhalation. In another example, the sensor 92 is in the form of an input device that receives input of information from the user, such as a button or a switch.

The sensor 92 detects attachment of the panel to the body housing. For example, the sensor 92 is in the form of a magnetic sensor (e.g., a Hall sensor including a Hall element that detects magnetism by use of the Hall effect). The sensor 92 detects that the panel including a magnetic-field applicator (e.g., a magnet and/or a magnetic substance) that applies a magnetic field to the magnetic sensor is present in the vicinity of the sensor 92.

The notifier 93 notifies the user of information. The notifier 93 is in the form of, for example, a display including a light-emitting element such as an LED, a display device that displays images, a sound output device that outputs sound, or a vibration device that vibrates.

For example, the LED notifies the user of operational information about the inhaler device 1 by emitting light in a predetermined manner. More specifically, the LED emits light to present the user with the following pieces of information: whether the inhaler device 1 is in powered-on state; how far preheating has progressed; the inhalation condition (such as the remaining time for which the user can inhale); and the current operation mode of the inhaler device 1 (such as, for example, inhalation mode and/or communication mode).

The memory 94 stores various information for operation of the inhaler device 1. The memory 94 is in the form of, for example, a non-volatile storage medium such as a flash memory. The memory 94 stores, in addition to computer-executable instructions for operating the inhaler device 1, information such as programs like firmware.

The communicator 95 is a communication interface capable of communication in conformity with any wired or wireless communication standard. For wireless communication, a suitable example of such communication standard is Wi-Fi (registered trademark) or Bluetooth (registered trademark). For wired communication, for example, a data communication cable is connected via the external connection terminal 70. This allows data related to operation of the inhaler device 1 to be input and output to and from an external device.

The communicator 95 may, in response to an opening 84 under the shutter 50 being exposed, activate its communication capability, and start communication with an external terminal via Bluetooth (registered trademark) or other method. The communicator 95 may, in response to the opening 84 under the shutter 50 being closed, end communication with an external terminal with which the communicator 95 is currently communicating. A particularly preferred mode of Bluetooth (registered trademark) connection between the communicator 95 and an external terminal may be Bluetooth Low Energy (BLE).

The holder 80 has an internal space 83. The holder 80 holds the stick substrate 100 with a portion of the stick substrate 100 being accommodated in the internal space 83. The holder 80 has the opening 84 that allows the internal space 83 to communicate with the external environment. The holder 80 holds the stick substrate 100 inserted into the internal space 83 through the opening 84. For example, the holder 80 is a tubular body having the opening 84 and a bottom 85 on its bases, and defines the internal space 83 having a columnar shape. The direction in which the stick substrate 100 is inserted into the internal space 83 will be herein defined as the longitudinal direction of the inhaler device 1.

In the holder 80, the inner wall of the internal space 83 has a pressing portion and a non-pressing portion (neither illustrated) in the longitudinal direction. When the internal space 83 receives the stick substrate 100, the pressing portion presses the stick substrate 100 in a direction perpendicular to the longitudinal direction. The stick substrate 100 is clamped by the holder 80 while being pressed and deformed by the pressing portion. As a result, the stick substrate 100 is heated by the heater 81 from its outer circumference while being pressed.

An air gap (not illustrated) is defined between the non-pressing portion and the stick substrate 100. As a result, the opening 84 and the bottom 85 communicate with each other through the air gap.

The holder 80 also serves to define a flow path for the air to be supplied to the stick substrate 100. The opening 84 defines an air inlet hole 86 through which air enters the flow path. More precisely, the air inlet hole 86 is an air gap between the non-pressing portion and the stick substrate 100. Air entering through the air inlet hole 86 as the user inhales is transported as indicated by dotted arrows through the stick substrate 100 to an air outlet hole 87 through which air exits the flow path.

The stick substrate 100 includes a substrate part 101, and a mouthpiece 102. The substrate part 101 includes an aerosol source. With the stick substrate 100 being held by the holder 80, at least a portion of the substrate part 101 is accommodated in the internal space 83, and at least a portion of the mouthpiece 102 sticks out from the opening 84. As the user sucks on and inhales from the mouthpiece 102 sticking out from the opening 84, air flows into the internal space 83 through the air inlet hole 86. The air is transported as indicated by the dotted arrows to the air outlet hole 87 of the mouthpiece 102 via the bottom 85, and then reaches the user's oral cavity together with an aerosol generated from the substrate part 101. The stick substrate 100 is an example of a substrate that retains an aerosol source.

The heater 81 heats the aerosol source to atomize the aerosol source and generate an aerosol. The heater 81 is in the form of a film, and positioned to surround the outer circumference of the holder 80. When the heater 81 generates heat, the substrate part 101 of the stick substrate 100 is heated from the outer circumference, and an aerosol is thus generated. The heater 81 generates heat upon receiving supply of power from the power supply 91. In one example, power may be supplied in this case in response to the sensor 92 detecting that the user has started inhalation, that a user's predetermined input action has been received, and/or that predetermined information has been input. The supply of power may be stopped in response to the sensor 92 detecting that the user has finished inhalation, that a user's predetermined input action has been received, and/or that predetermined information has been input. The heater 81 is an example of a heater that heats the substrate with electric power supplied from a battery, and thereby generates an aerosol.

The heat insulator 82 prevents transfer of heat from the heater 81 to other components. For example, the heat insulator 82 is a vacuum heat insulator, an aerogel heat insulator, or other heat insulator.

An exemplary configuration of the inhaler device 1 has been described above. Of course, the inhaler device 1 is not limited to the above-mentioned configuration but may take various exemplary configurations as presented below.

In one example, the heater 81 may be in the form of a blade, and disposed so as to protrude from the bottom 85 of the holder 80 toward the internal space 83. In that case, the heater 81 in the form of a blade is inserted into the substrate part 101 of the stick substrate 100 to heat the substrate part 101 of the stick substrate 100 from the inside. In another example, the heater 81 may be positioned to cover the bottom 85 of the holder 80. In still another example, the heater 81 may be implemented as a combination of two or more of the following heaters: a first heater that covers the outer circumference of the holder 80; a second heater that is in the form of a blade; and a third heater that covers the bottom 85 of the holder 80.

The aerosol source is not necessarily atomized by means of heating applied by the heater 81. For example, the aerosol source may be atomized by means of induction heating.

Overview of Operation of Inhaler Device

According to the embodiment, the notifier 93 of the inhaler device 1 includes a plurality of displays configured to, when the inhaler device 1 is performing an operation, display a state of the inhaler device 1. The controller 90 is configured to, in response to an error occurring in the inhaler device 1, display an indication of occurrence of the error on the displays in a manner that causes a first subset and a second subset of the displays to turn on, and that causes a third subset of the displays to turn off.

The operation mentioned above is a normal operation, and may be at least one of the following operations: an operation of heating the stick substrate 100; an operation of enabling inhalation of an aerosol; an operation of providing notification of the remaining level of the rechargeable battery of the power supply 91; and an operation of charging the rechargeable battery of the power supply 91.

The error may be an error that is recoverable neither by an action performed on the inhaler device 1 nor by the passage of time. Alternatively, the error may be a warning level error in the system of the inhaler device 1 that warrants a warning, an error due to the temperature of the inhaler device 1 being outside a predetermined temperature range, or an error due to removal of a protection component for the inhaler device 1.

In the present case, the displays are N LEDs (N is a natural number).

A warning level error that occurs in the system of the inhaler device 1 will be referred to as "system-related error". An error due to the temperature of the inhaler device 1 being outside a predetermined temperature range will be referred to as "temperature error". An error that is recoverable neither by an action performed on the inhaler device 1 nor by the passage of time will be referred to as "permanent failure error". An error due to removal of a protection component for the inhaler device 1 will be referred to as "panel error". The protection component for the inhaler device 1 is not necessarily the panel 10 but may be any component.

Further, a manner of display that causes a first subset and a second subset of the N LEDs to turn on, and causes a third subset of the N LEDs to turn off will be referred to as "gap-toothed manner".

As described above, examples of errors include a system-related error, a temperature error, a permanent failure error, and a panel error. In this regard, whichever of these errors occurs, an indication of occurrence of the error may be displayed in a gap-toothed manner. The following description assumes a situation where a permanent failure error has occurred and an indication of occurrence of the permanent failure error is to be displayed in a gap-toothed manner on the N LEDs.

Specific Examples of Normal Operations of Inhaler Device

The following operations are described below as examples of normal operations of the inhaler device 1: an operation of preheating the stick substrate 100; an operation of enabling inhalation of an aerosol; an operation of providing notification of the remaining level of the rechargeable battery of the power supply 91; and an operation of charging the rechargeable battery of the power supply 91.

Figure 4:
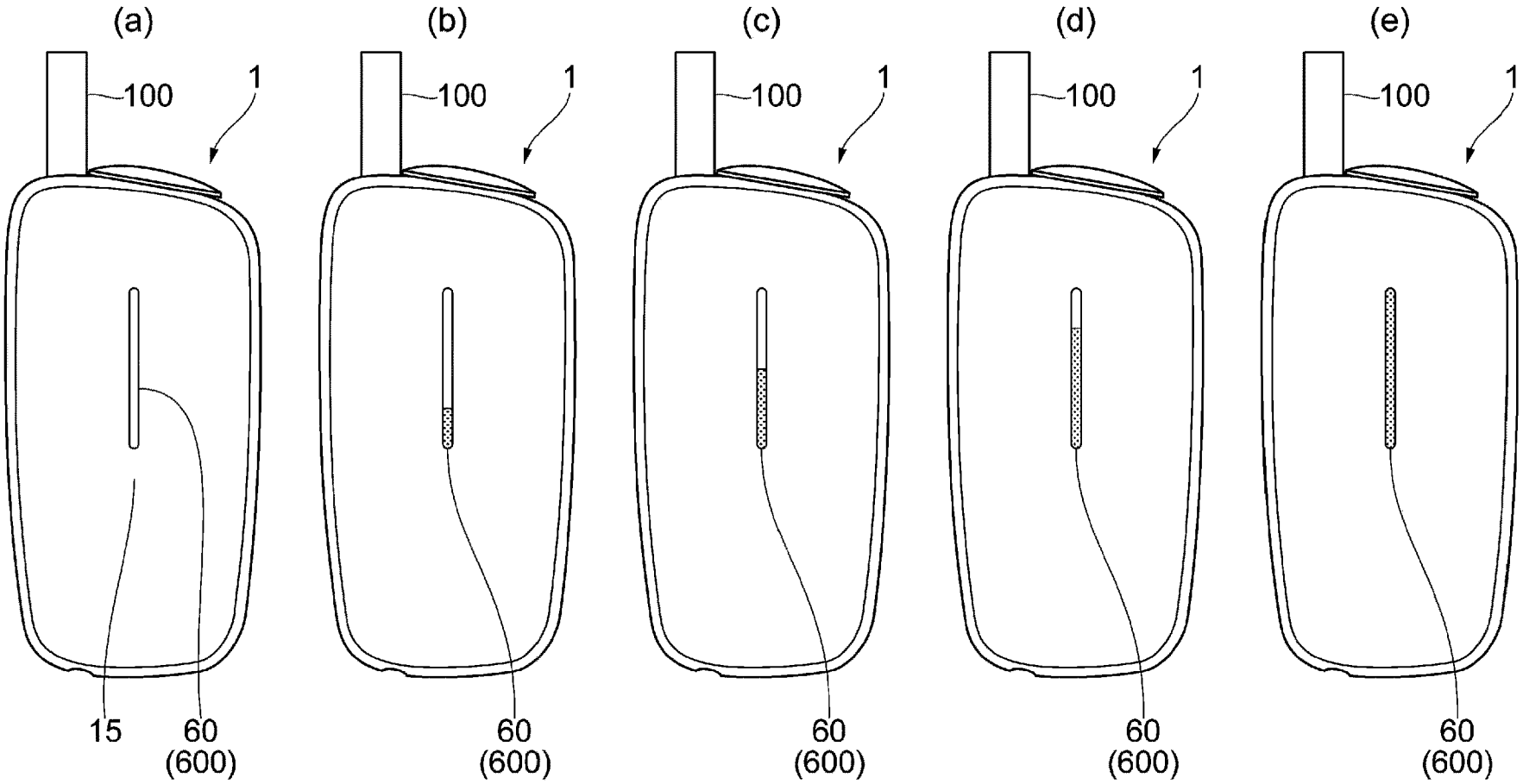
FIGS. 4(*a*) to 4(*e*) illustrate an example of how LEDs are displayed when the inhaler device performs an operation of pre-heating a stick substrate.

FIGS. 4(*a*) to 4(*e*) illustrate an example of how N LEDs 600 visible through the display window 60 are displayed when the inhaler device 1 performs an operation of preheating the stick substrate 100. The operation of preheating the stick substrate 100 is an example of an operation of heating the stick substrate 100.

Prior to preheating of the stick substrate 100, the N LEDs 600 are all OFF (unlit) as illustrated in FIG. 4(*a*). In this state, when the user presses down on the button region 15 for a few seconds, the inhaler device 1 starts an operation of preheating the stick substrate 100.

When the inhaler device 1 starts an operation of preheating the stick substrate 100, the N LEDs 600, which are currently OFF, are turned on (lit) in sequence from the bottom to the top, and the number of ON (lit) LEDs thus increases gradually. The increasing number of ON LEDs indicates how far preheating has progressed. For example, FIG. 4(*b*) illustrates the display when one quarter of the preheating time has elapsed, with one quarter of the N LEDs 600 being ON. FIG. 4(*c*) illustrates the display when two quarters of the preheating time have elapsed, with two quarters of the N LEDs 600 being ON. FIG. 4(*d*) illustrates the display when three quarters of the preheating time have elapsed, with three quarters of the N LEDs 600 being ON. FIG. 4(*e*) illustrates the display at the end of the preheating time, with all of the N LEDs 600 being ON.

Figure 5:
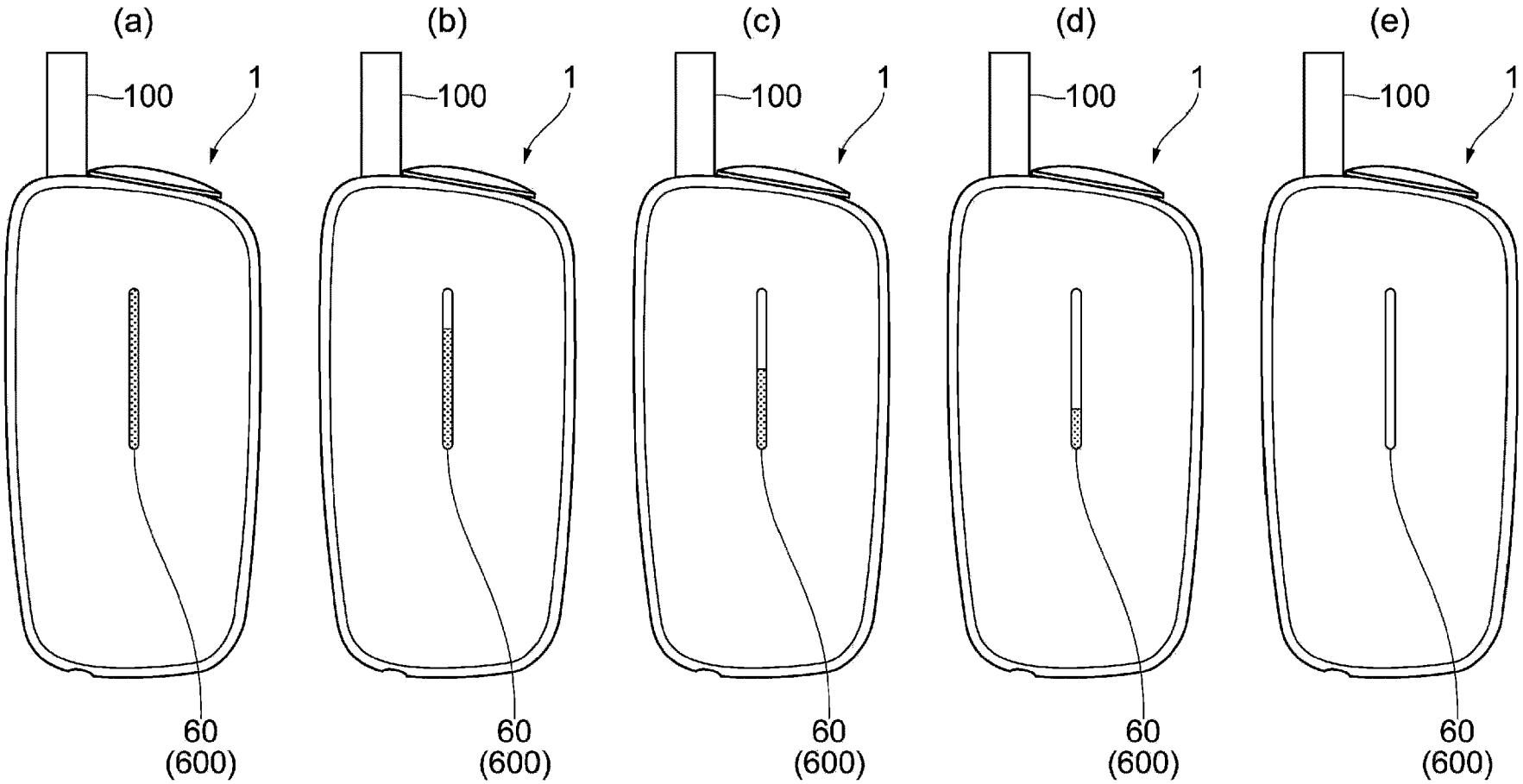
FIGS. 5(*a*) to 5(*e*) illustrate an example of how the LEDs are displayed when the inhaler device performs an operation of enabling inhalation of an aerosol.

FIGS. 5(*a*) to 5(*e*) illustrate an example of how N LEDs 600 visible through the display window 60 are displayed when the inhaler device 1 performs an operation of enabling inhalation of an aerosol.

Prior to an operation of enabling inhalation of an aerosol, the N LEDs 600 are all ON as illustrated in FIG. 5(*a*). In this state, the inhaler device 1 starts an operation of enabling the user to inhale an aerosol generated through heating of the stick substrate 100.

When the inhaler device 1 starts an operation of enabling inhalation of an aerosol, the N LEDs 600, which are currently ON, are turned off in sequence from the top to the bottom, and the number of ON LEDs thus decreases gradually. The decreasing number of ON LEDs indicates how much the time remaining for the user to be able to inhale has decreased. For example, FIG. 5(*b*) illustrates the display when one quarter of a possible inhalation period for which the user can inhale from the inhaler device 1 has elapsed, with three quarters of the N LEDs 600 being ON. FIG. 5(*c*) illustrates the display when two quarters of the possible inhalation period have elapsed, with two quarters of the N LEDs 600 being ON. FIG. 5(*d*) illustrates the display when three quarters of the possible inhalation period have elapsed, with one quarter of the N LEDs 600 being ON. FIG. 5(*e*) illustrates the display at the end of the possible inhalation period, with all of the N LEDs 600 being OFF.

Figure 6:
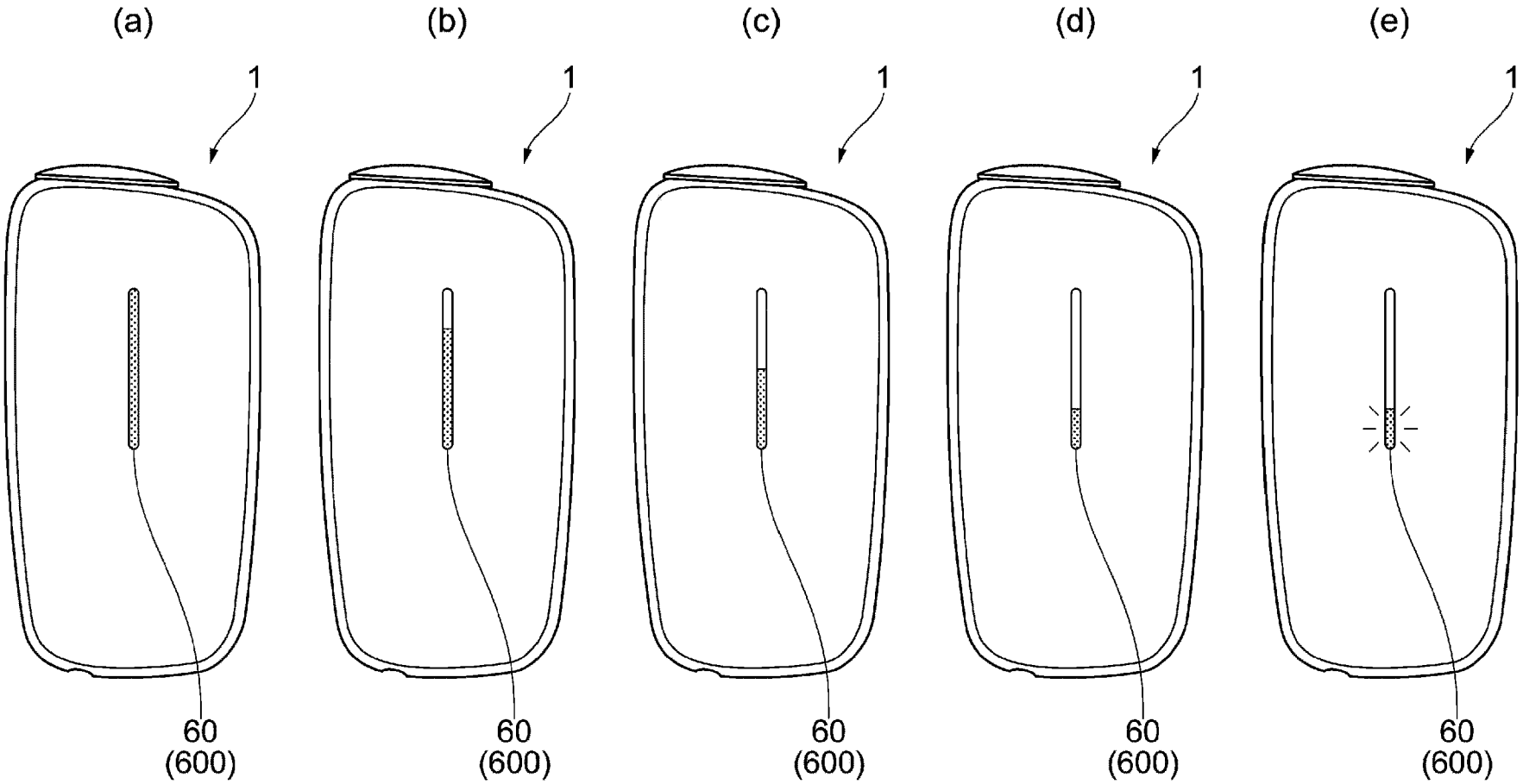
FIGS. 6(*a*) to 6(*e*) illustrate an example of how the LEDs are displayed when the inhaler device performs an operation of providing notification of the remaining battery level.

FIGS. 6(*a*) to 6(*e*) illustrate an example of how N LEDs 600 visible through the display window 60 are displayed when the inhaler device 1 performs an operation of providing notification of how much the rechargeable battery of the power supply 91 remains (to be referred to as "remaining battery level" hereinafter).

At the time when the remaining battery level of the power supply 91 is 100%, the N LEDs 600 are all ON as illustrated in FIG. 6(*a*). In this state, the inhaler device 1 starts using its rechargeable battery.

When the inhaler device 1 starts using its rechargeable battery, the N LEDs 600, which are currently ON, are turned off in sequence from the top to the bottom, and the number of ON LEDs thus decreases gradually. The decreasing number of ON LEDs indicates how much the remaining battery level has decreased. For example, FIG. 6(*b*) illustrates the display when the remaining battery level is 75%, with three quarters of the N LEDs 600 being ON. FIG. 6(*c*) illustrates the display when the remaining battery level is 50%, with two quarters of the N LEDs 600 being ON. FIG. 6(*d*) illustrates the display when the remaining battery level is 25%, with one quarter of the N LEDs 600 being ON. FIG. 6(*e*) illustrates the display when the remaining battery level is just enough for inhalation from a single remaining stick substrate 100, with the lower-positioned LED or LEDs of the N LEDs 600 blinking.

Figure 7:
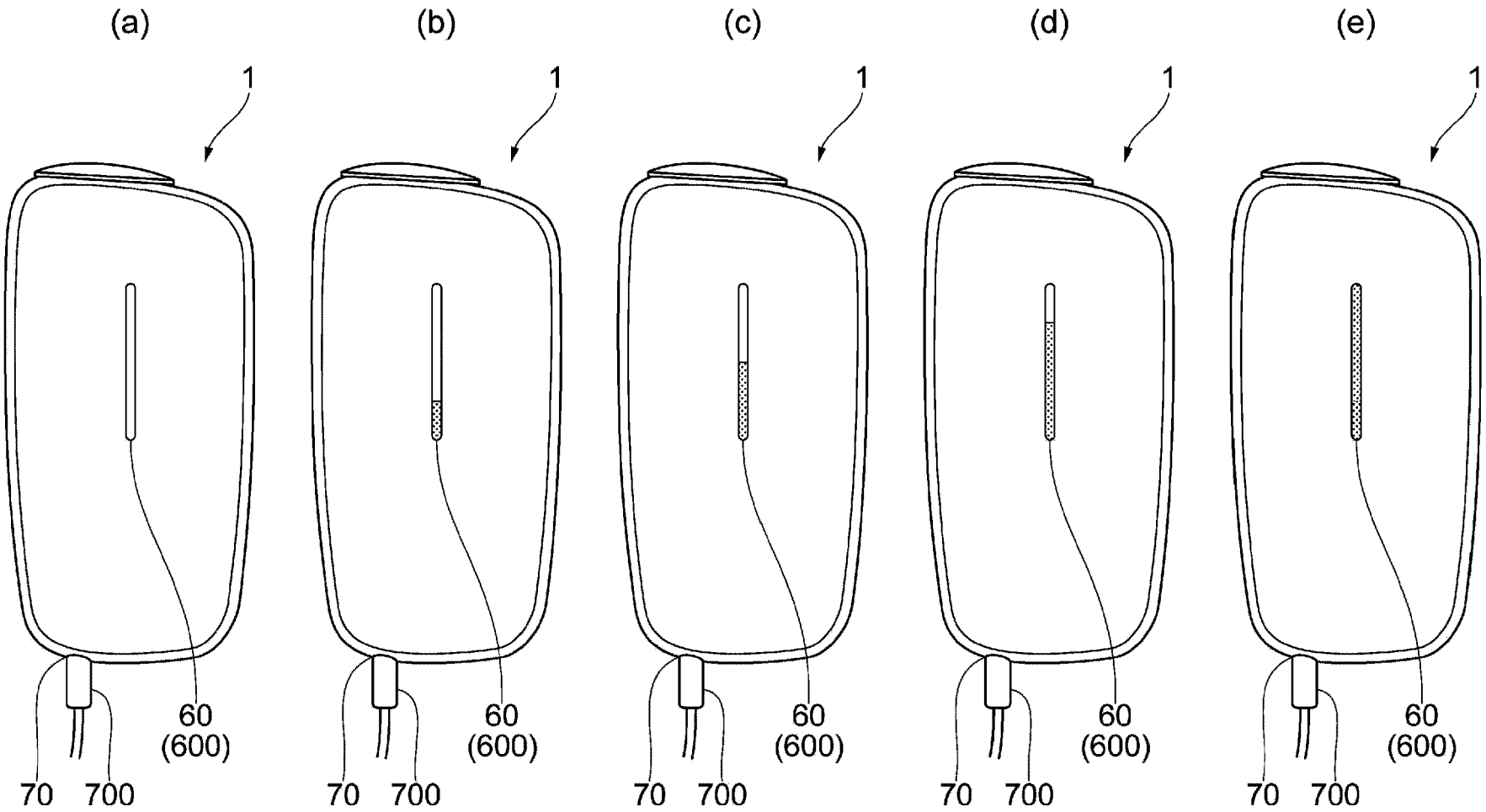
FIGS. 7(*a*) to 7(*e*) illustrate an example of how the LEDs are displayed when the inhaler device performs an operation of charging a rechargeable battery.

FIGS. 7(*a*) to 7(*e*) illustrate an example of how N LEDs 600 visible through the display window 60 are displayed when the inhaler device 1 performs an operation of charging the rechargeable battery of the power supply 91.

Prior to charging of the rechargeable battery, the N LEDs 600 are all OFF as illustrated in FIG. 7(*a*). In this state, when the user connects a USB cable 700 to the external connection terminal 70, the inhaler device 1 starts an operation of charging the rechargeable battery.

When the inhaler device 1 starts an operation of charging the rechargeable battery, the N LEDs 600, which are currently OFF, are turned on in sequence from the bottom to the top, and the number of ON LEDs thus increases gradually. The increasing number of ON LEDs indicates how far charging of the rechargeable battery has progressed. For example, FIG. 7(*b*) illustrates the display when charging of the rechargeable battery has progressed by 25%, with one quarter of the N LEDs 600 being ON. FIG. 7(*c*) illustrates the display when charging of the rechargeable battery has progressed by 50%, with two quarters of the N LEDs 600 being ON. FIG. 7(*d*) illustrates the display when charging of the rechargeable battery has progressed by 75%, with three quarters of the N LEDs 600 being ON. FIG. 7(*e*) illustrates the display at the end of charging of the rechargeable battery, with all of the N LEDs 600 being ON.

Example of Specific Operation of Inhaler Device in Event of Error

Operation of the inhaler device 1 when a permanent failure error occurs will now be described as an example of how the inhaler device 1 operates when an error occurs. The following description assumes a case where N LEDs 600 are eight LEDs that are arranged vertically in a line, with the eight LEDs designated as LED No. 8, LED No. 7, . . . , LED No. 1 in sequence from the top to the bottom.

When a permanent failure error occurs, power is no longer supplied from the power supply 91. Accordingly, the controller 90 is configured to, in response to power being supplied from an external source with a permanent failure error occurring, display an indication of occurrence of the permanent failure error on the eight LEDs 600. For example, the controller 90 is configured to, in response to a permanent failure error occurring when the user connects a powered USB cable to the external connection terminal 70 and the inhaler device 1 becomes a non-charging state, display an indication of occurrence of the permanent failure error on the eight LEDs 600.

Figure 8:
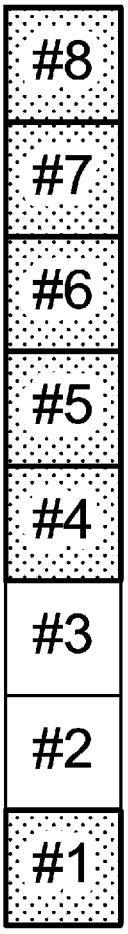
FIG. 8 illustrates an example of how the LEDs are displayed in a gap-toothed manner when a permanent failure error occurs.

FIG. 8 illustrates an example of how the eight LEDs 600 are displayed in a gap-toothed manner when a permanent failure error occurs. In this case, the controller 90 causes each of the LEDs Nos. 1, and 4 to 8 to turn on in a normal fashion as indicated by the dotted hatching inside a box bounded with thick solid lines. Meanwhile, the controller 90 causes each of the LEDs Nos. 2 and 3 to turn off as indicated in blank inside a box bounded by thin solid lines. After performing the above-mentioned display for 5000 milliseconds, the controller 90 ends the display. In this regard, 5000 milliseconds are given as an illustrative example only, and not intended to be limiting. 5000 milliseconds represent an example of a predetermined time.

As used herein, the term "gap-toothed manner" refers to a manner of display that causes a first subset and a second subset of the eight LEDs 600 to turn on, and causes a third subset of the eight LEDs 600 to turn off. In this case, although the first, second, and third subsets may be any subsets of the eight LEDs 600s, it is desirable that the first, second, and third subsets be respectively a subset including an LED at one end of the arrangement of the LEDs, a subset including an LED at the other end of the arrangement of the LEDs, and a subset other than the two subsets mentioned above. For example, in the example illustrated in FIG. 8, it is desirable for the controller 90 to cause a subset including the LED No. 1 and a subset including the LED No. 8 to turn on, and cause a subset other than these two subsets to turn off. This is because if the LED No. 1 is turned off, the user may have the mistaken impression that the LEDs Nos. 2 to No. 8 represent all of the LEDs, whereas if the LED No. 8 is turned off, the user may have the mistaken impression that the LEDs Nos. 1 to 7 represent all of the LEDs.

A gap-toothed manner may be defined more generally as a manner of display that causes three or more subsets of the eight LEDs 600 to turn on, and causes the remaining subset of the eight LEDs 600 sandwiched between these subsets to turn off. For instance, in the example in FIG. 8, the controller 90 may cause the LEDs Nos. 1, 3, and 5 to 8 to turn on, and cause the LEDs Nos. 2 and 4 to turn off. Alternatively, the controller 90 may cause the LEDs Nos. 1 to 4, 6, and 8 to turn on, and cause the LEDs Nos. 5 and 7 to turn off.

When the display in FIG. 8 ends, the controller 90 causes the inhaler device 1 to transition to a sleep mode. A sleep mode in this case refers to a mode in which almost all of the functions of the inhaler device 1 are unavailable, except for functions such as detecting the opening of the shutter 50, the connection of a USB cable, or other actions, or monitoring the remaining battery level. The controller 90 is configured to perform the display illustrated in FIG. 8 again in response to one of the following actions being performed in sleep mode: opening of the shutter 50; depression of the button region 15; and removal of the panel 10. The controller 90 is also configured to, in response to a USB cable being disconnected, cause the inhaler device 1 to transition to a shipping mode (power-off).

Detailed Operation of Inhaler Device in Event of Error

Figure 9:
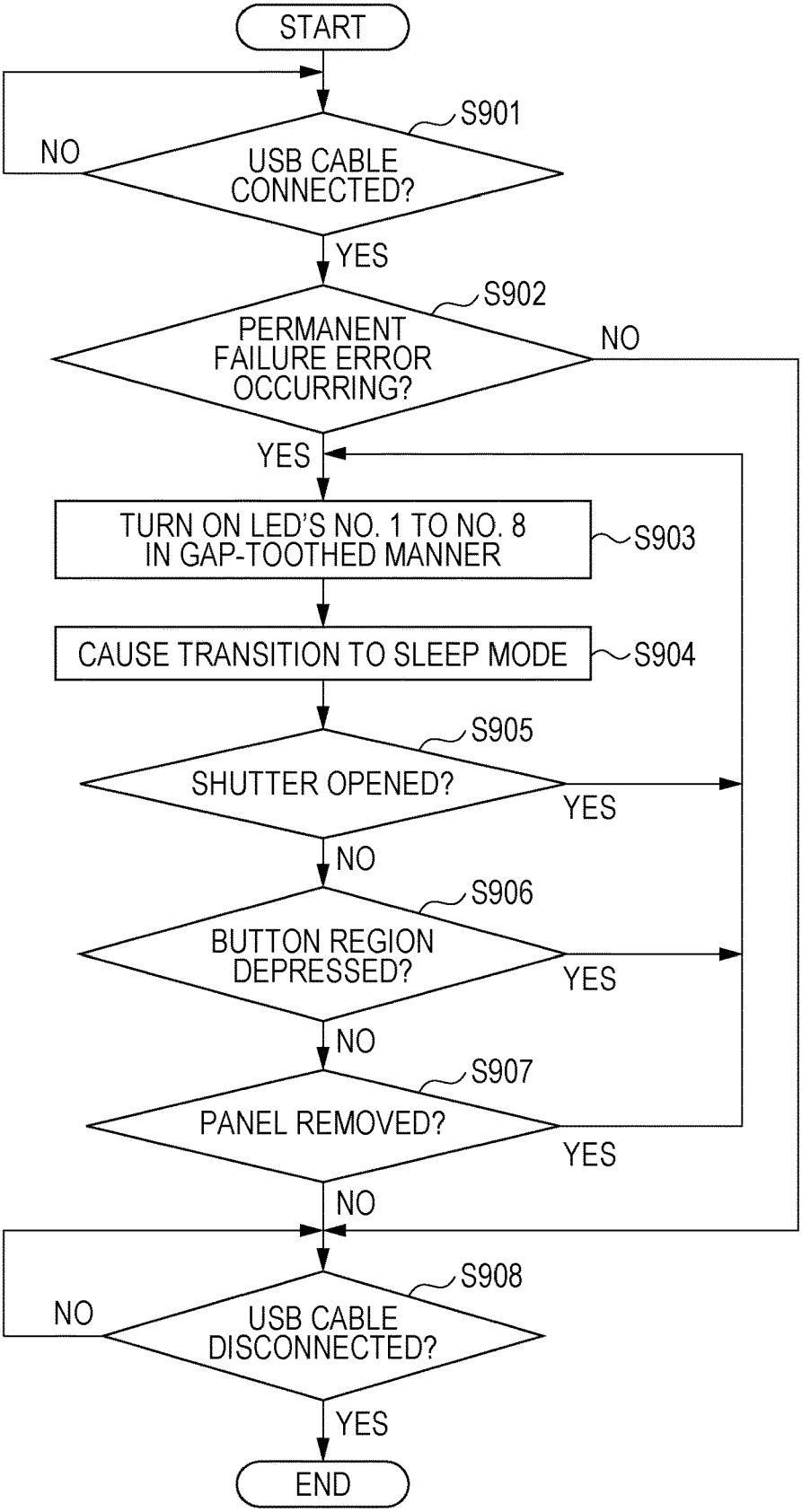
FIG. 9 is a flowchart illustrating an example of how a controller of the inhaler device according to the embodiment of the present disclosure operates when a permanent failure error occurs.

FIG. 9 is a flowchart illustrating an example of how the controller 90 of the inhaler device 1 according to the embodiment operates when a permanent failure error occurs.

As illustrated in FIG. 9, the controller 90 first determines whether the USB cable 700 has been connected to the external connection terminal 70 (step 901). If the controller 90 determines that the USB cable 700 has not been connected to the external connection terminal 70, the controller 90 repeats step 901. If the controller 90 determines at step 901 that the USB cable 700 has been connected to the external connection terminal 70, the controller 90 determines whether a permanent failure error is occurring (step 902).

If the controller 90 determines at step 902 that a permanent failure error is occurring, the controller 90 causes the LEDs Nos. 1 to 8 to turn on in a gap-toothed manner (step 903). For example, the controller 90 causes the LEDs Nos. 1, and 4 to 8 to turn on, and causes the LEDs Nos. 2 and 3 to turn off. The controller 90 then causes the inhaler device 1 to transition to the sleep mode (step 904).

Subsequently, the controller 90 determines whether an action of opening the shutter 50 has been performed (step 905). If the controller 90 determines that an action of opening the shutter 50 has been performed, the controller 90 returns the processing to step 903, and performs the turning-on of the LEDs in a gap-toothed manner described above with reference to step 903.

If the controller 90 determines at step 905 that an action of opening the shutter 50 has not been performed, the controller 90 determines whether an action of depressing the button region 15 has been performed (step 906). If the controller 90 determines that an action of depressing the button region 15 has been performed, the controller 90 returns the processing to step 903, and performs the turning-on of the LEDs in a gap-toothed manner described above with reference to step 903.

If the controller 90 determines at step 906 that an operation of depressing the button region 15 has not been performed, the controller 90 determines whether the panel 10 has been removed (step 907). If the controller 90 determines that the panel 10 has been removed, the controller 90 returns the processing to step 903, and performs the turning-on of the LEDs in a gap-toothed manner described above with reference to step 903.

If the controller 90 determines at step 907 that the panel 10 has not been removed, the controller 90 determines whether the USB cable 700 has been disconnected from the external connection terminal 70 (step 908). In this regard, also if the controller 90 determines at step 902 that a permanent failure error is not occurring, the controller 90 determines, after a normal operation such as charging of the rechargeable battery of the power supply 91 is performed, whether the USB cable 700 has been disconnected from the external connection terminal 70 (step 908).

If the controller 90 determines at step 908 that the USB cable 700 has not been disconnected from the external connection terminal 70, the controller 90 repeats step 908. If the controller 90 determines at step 908 that the USB cable 700 has been disconnected from the external connection terminal 70, the controller 90 ends the processing. That is, the controller 90 causes the inhaler device 1 to transition to the shipping mode.

Modifications

Although the foregoing description is directed to a case where N LEDs 600 are arranged vertically in a line, this is not intended to be limiting. For example, the N LEDs 600 may be arranged in any configuration as long as the N LEDs 600 are arranged continuously. For example, the N LEDs 600 may be arranged in an annular configuration. Alternatively, the N LEDs 600 may be arranged discretely rather than continuously.

Although the present disclosure has been described above as being applied to a heated tobacco product, this is not intended to be limiting. The present disclosure is applicable to a variety of inhaler devices used to inhale an aerosol, such as electronic cigarettes and nebulizers. Examples of inhalable components to be generated may include, other than an aerosol, invisible gases such as vapor. Further, the present disclosure may be applied to a display device that is connected to an apparatus such as an inhaler to display information about the apparatus. In that case, the N LEDs 600 represents an example of a plurality of displays configured to, when the apparatus is performing an operation, display a state of the apparatus. The controller 90 represents an example of a controller configured to, in response to an error occurring in the apparatus, display an indication of occurrence of the error on the displays in a manner that causes a first subset and a second subset of the displays to turn on, and that causes a third subset of the displays to turn off.

REFERENCE SIGNS LIST

1 inhaler device
10 panel
20 body housing
30 body
40 housing
50 shutter
60 display window
70 external connection terminal
80 holder
81 heater
82 heat insulator
90 controller
91 power supply
92 sensor
93 notifier
94 memory
95 communicator

The invention claimed is:

1. An inhaler device comprising:

a heater that heats a substrate with electric power to generate an aerosol, the substrate retaining an aerosol source, the electric power being provided from a battery;

a plurality of displays configured to, when the inhaler device is performing an operation, display a state of the inhaler device, the plurality of displays being arranged contiguously to form a single, unbroken light strip; and a controller configured to sequentially, in response to an error occurring in the inhaler device, display an indication of occurrence of the error on the displays in a gap-toothed manner that causes a first subset and a second subset of the displays to turn on, and that causes a third subset of the displays to turn off, end the display of the indication of occurrence after the indication of occurrence of the error is displayed for a predetermined time;

then cause the inhaler device to a sleep mode after ending the display of the indication of occurrence;

then redisplay the indication of occurrence after the inhaler device enters the sleep mode, in response to at least one of following triggers including:

opening of a shutter;

depression of a button that supplies the electric power from the battery to the heater; and removal of a protection component of the inhaler device.

2. The inhaler device according to claim 1, wherein the first subset includes one display at an end of the displays, and wherein the second subset includes one display at an other end of the displays.

3. The inhaler device according to claim 1, wherein the operation comprises at least one of an operation of heating the substrate, an operation of enabling inhalation of the aerosol, an operation of providing notification of a remaining level of the battery, or an operation of charging the battery.

4. The inhaler device according to claim 1, wherein the error comprises an error that is recoverable neither by an action performed on the inhaler device nor by passage of time.

5. The inhaler device according to claim 4, wherein the controller is configured to, in response to electric power being supplied from an external source with the error occurring, display the indication of occurrence of the error on the displays.

6. The inhaler device according to claim 1, wherein the controller is configured to, in response to the shutter being opened after display of the indication of occurrence of the error ends, display the indication of occurrence of the error on the displays again, the shutter being a shutter for an opening into which the substrate is to be inserted.

7. The inhaler device according to claim 1, wherein the controller is configured to, in response to the button being depressed after display of the indication of occurrence of the error ends, display the indication of occurrence of the error on the displays again, the button being a button for supplying electric power from the battery to the heater.

8. The inhaler device according to claim 1, wherein the controller is configured to, in response to the protection component for the inhaler device being removed after display of the indication of occurrence of the error ends, display the indication of occurrence of the error on the displays again.

9. A display device comprising:

a plurality of displays configured to, when an apparatus is performing an operation, display a state of the apparatus; and a controller configured to, in response to an error occurring in the apparatus:

display an indication of occurrence of the error on the displays in a manner that causes a first subset and a second subset of the displays to turn on, and that causes a third subset of the displays to turn off;

end the display of the indication of occurrence after the indication of occurrence of the error is displayed for a predetermined time;

then cause an inhaler device to a sleep mode after ending the display of the indication of occurrence;

then redisplay the indication of occurrence after the inhaler device enters the sleep mode, in response to at least one of following triggers including:

opening of a shutter of the inhaler;

depression of a button of the inhaler that supplies an electric power from a battery of the inhaler to a heater of the inhaler; and removal of a protection component of the inhaler device.

10. The inhaler device according to claim 9, wherein the first subset includes one display at an end of the displays, and wherein the second subset includes one display at an other end of the displays.

11. The display device according to claim 9, wherein the displays are arranged continuously.

12. A display method comprising the steps of:

when an apparatus is performing an operation, displaying a state of the apparatus on a plurality of displays;

in response to an error occurring in the apparatus, displaying an indication of occurrence of the error on the displays in a manner that causes a first subset and a second subset of the displays to turn on, and that causes a third subset of the displays to turn off;

ending the display of the indication of occurrence after the indication of occurrence of the error is displayed for a predetermined time;

then causing the apparatus to a sleep mode after ending the display of the indication of occurrence;

then redisplaying the indication of occurrence after the apparatus enters the sleep mode, in response to at least one of following triggers including:

opening of a shutter of the apparatus;

depression of a button of the apparatus that supplies an electric power from a battery of the apparatus to a heater of the apparatus; and removal of a protection component of the apparatus.

* * * * *